US009086244B2

(12) United States Patent
Crayssac et al.

(10) Patent No.: US 9,086,244 B2
(45) Date of Patent: Jul. 21, 2015

(54) HEAT EXCHANGER

(75) Inventors: Frederic Crayssac, Velizy (FR); Frederic Rousseau, Fontenay le Fleury (FR); Marc Wagner, Saint Maur des Fosses (FR)

(73) Assignee: L'Air Liquide Société Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 907 days.

(21) Appl. No.: 13/130,375

(22) PCT Filed: Nov. 24, 2009

(86) PCT No.: PCT/FR2009/052269

§ 371 (c)(1),
(2), (4) Date: May 20, 2011

(87) PCT Pub. No.: WO2010/058142

PCT Pub. Date: May 27, 2010

(65) Prior Publication Data

US 2011/0220482 A1 Sep. 15, 2011

(30) Foreign Application Priority Data

Nov. 24, 2008 (FR) ..... 0857951

(51) Int. Cl.

| | |
|---|---|
| ***B01D 3/00*** | (2006.01) |
| ***F28F 3/02*** | (2006.01) |
| ***F25J 3/04*** | (2006.01) |
| ***F25J 5/00*** | (2006.01) |

(Continued)

(52) U.S. Cl.

CPC ..... *F28F 3/025* (2013.01); *F25J 3/04412* (2013.01); *F25J 5/005* (2013.01); *F28D 9/0068* (2013.01); *F28F 9/026* (2013.01); *F25J 2250/04* (2013.01); *F25J 2290/32* (2013.01)

(58) Field of Classification Search

CPC ..... F28F 9/026; F28F 9/0263; F28F 9/0265; F28F 9/0268; F28F 9/0278; F28D 3/04; F25B 9/00; F25B 9/14

USPC ..... 62/630; 165/76, 174, 176

See application file for complete search history.

(56) References Cited

U.S. PATENT DOCUMENTS 3,266,568 A * 8/1966 Butt et al. ..... 165/166
3,310,105 A * 3/1967 Butt ..... 165/166

(Continued)

FOREIGN PATENT DOCUMENTS

FR 2547898 12/1984
FR 2547898 A * 12/1984

(Continued)

OTHER PUBLICATIONS

PCT/FR2009/052269, International Search Report and Written Opinion, Sep. 25, 2012.

(Continued)

*Primary Examiner* — Frantz Jules
*Assistant Examiner* — Brian King
(74) *Attorney, Agent, or Firm* — Justin K. Murray

(57) ABSTRACT

The present invention relates to the vaporization of a liquid by exchanging heat with a second fluid by means of a heat exchanger of the vertical plate type. It applies in particular to air distillation installations.

14 Claims, 6 Drawing Sheets

(51) Int. Cl.
*F28D 9/00* (2006.01)
*F28F 9/02* (2006.01)

(56) References Cited

U.S. PATENT DOCUMENTS

| | | | | |
|---|---|---|---|---|
| 3,380,517 | A * | 4/1968 | Butt | 165/166 |
| 4,599,097 | A | 7/1986 | Petit et al. | |
| 5,730,209 | A * | 3/1998 | Sunder et al. | 165/95 |
| 6,338,384 | B1 | 1/2002 | Sakaue et al. | |
| 7,489,513 | B2 * | 2/2009 | Lai et al. | 361/710 |
| 2008/0225492 | A1 * | 9/2008 | Murasawa et al. | 361/710 |

FOREIGN PATENT DOCUMENTS

| | | |
|---|---|---|
| GB | 2316478 | 2/1998 |
| JP | 60-17601 | 1/1985 |
| JP | 2008-089213 | 4/2008 |

OTHER PUBLICATIONS

Chakravarthy, Vijayaraghavan S., et al., "Developments in Falling Film Type (Downflow) Reboilers in the Air Separation Industry," Proceedings of Fifth International Conference on Enhanced, Compact and Ultra-Compact Heat Exchangers: Science, Engineering ADN Technology, vol. P6, ECI Symposium Series, Sep. 1, 2005 (pp. 264-272).

Japanese Patent Application No. 2011-536938, First Office Action, Sep. 10, 2013.

* cited by examiner

HEAT EXCHANGER

This application is a §371 of International PCT Application PCT/FR2009/052269, filed Nov. 24, 2009.

BACKGROUND

1. Field of the Invention

The present invention relates to the vaporization of a liquid by exchanging heat with a second fluid by means of a heat exchanger of the vertical plate type. It applies in particular to air distillation installations.

2. Related Art

In air distillation installations of the double column type, the liquid oxygen that is in the vessel of the low-pressure column is vaporized by exchanging heat with the gaseous nitrogen tapped from the head of the medium-pressure column. For a given operating pressure of the low-pressure column, the temperature difference between the oxygen and the nitrogen made necessary by the structure of the heat exchanger imposes the operating pressure of the medium-pressure column. It is therefore desirable that this temperature difference be as small as possible in order to minimize the expenditure associated with compressing the air to be treated injected into the medium-pressure column.

The technology currently used for these phase-change exchangers is that of aluminum exchangers with brazed plates and fins which make it possible to obtain very compact members providing a large exchange surface area. These exchangers consist of plates between which waves or fins are inserted thus forming a stack of vaporization "passageways" and of condensation "passageways". There are various types of waves such as straight, perforated or partially offset ("serrated") waves.

In the case of vaporizers operating in descending-film vaporization mode, a portion of the apparatus is dedicated to the distribution of the liquid in the vaporization passageways and between the channels of the exchange wave.

This distribution specific to each vaporizer is carried out conventionally according to the principle described in FR-A-2547898: the vaporization passageways are supplied through the top of the condensation passageways. The oxygen then passes through an array of holes which ensure its primary distribution into the vaporization passageways. It then flows through a band of waves with a horizontal generatrix which ensures a finer distribution called secondary distribution (dividing of the liquid between channels).

The liquid oxygen that is vaporized contains impurities in the form of solutes. The main impurities are nitrous oxide ($N_2O$), carbon dioxide ($CO_2$), hydrocarbons ($C_2$, $C_3$, etc.). Depending on the operating conditions, these impurities may be deposited in the vaporization passageways (either in solid form or in liquid form). It is important to industrially control the formation of these solid or liquid deposits in order to prevent any risk of explosion.

One of the important parameters in the formation of deposits is the liquid flow rate per channel (or expressed per meter of perimeter to be wetted). Specifically, when the liquid flow rate per channel is insufficient to wet the wall, there is formation of deposits by dry vaporization.

In this type of vaporizer (film vaporizer), the distribution of the liquid oxygen plays an essential role in its operation (performance and safety). It is therefore necessary to ensure, in all circumstances, a good liquid distribution inside each channel. For this, the liquid distribution must be sufficiently uniform between channels. A non-uniform liquid distribution may cause bad wetting of the waves, notably in the bottom portion of the exchanger, and consequently the formation of deposits by dry vaporization. The difficulty is in ensuring an equivalent liquid flow rate in all the channels considering the number of channels per passageway and per body (550 channels/passageway, 55 000 channels/body).

The quality of this liquid distribution depends on a good design and dimensioning of the distributor.

The so-called secondary distribution (dividing of the liquid between channels) uses a wave band with a horizontal generatrix and with partial offset.

The positioning of this wave inside each vaporization passageway has two drawbacks:

- The existence on either side of the passageway of two orifices (free spaces) 31 due to the profile of the lateral bars used (FIG. 1A).
- Possibility of clearance 31 at the junction between two wave mats. Specifically, several wave bands can be placed side by side in order to cover the whole of the width of the passageway (FIG. 2).

These drawbacks mean that there are preferential passageways for the liquid in this band with horizontal generatrix ("hardway"), causing an oversupply of liquid to the channels situated just beneath but, more importantly, an undersupply of liquid to the channels on the periphery of the latter.

FIG. 1A shows a portion of the exchanger according to the prior art seen from above. The bar 7 has a U-shaped section piece consisting of two layers the outer one of which has a rectangular cross section while the inner one has a sinusoidal edge 20. In figure al, the same portion of the exchanger is seen from the front.

The wave with horizontal generatrix 1 is between two plates 35 defining an exchanger passageway that is closed off by a bar 7.

The clearances 31 between the waves and the bars are also indicated in FIG. 2 for an exchanger according to the prior art.

SUMMARY OF THE INVENTION

According to the invention, the bar preferably consists of two layers but the inner layer has cutouts 33 or flats depending on the shape of the bar 7 in which the U-shaped section piece is removed, which allows the waves 1,3 to fit into the bar 7.

According to one subject of the invention, a heat exchanger is provided for vaporizing a liquid by exchanging heat with a second fluid comprising a parallelepipedal body formed of an assembly of parallel vertical plates defining between them a multitude of flat passageways and lateral bars closing off the passageways to the outside, means for sending the liquid into a first set of passageways and the second fluid into the remaining passageways, a packing element for distributing the liquid at the top end of the passageways of said first set, over the whole horizontal length of said passageways, by a fine distribution over the whole length of these passageways, characterized in that at least one of the lateral bars has, toward the inside of the exchanger, a rounded profile over most of its length and a flat profile over a portion of its length and in that one edge of the packing element contacts the portion of its length in which the profile is flat.

According to other optional subjects:

- the packing element is fitted into at least one of the lateral bars;
- the packing element consists of at least two waves having a shape and a dimension of undulation that are substantially identical and with horizontal generatrices and optionally with a partial vertical offset, the at least two waves contacting one another, preferably so that the edges of the undulations join perfectly, without leaving clearance between the waves;

the two waves mutually interpenetrate;

the two waves have at least one cutout and the cutouts of the two waves have matching shapes and optionally:

a) each wave has an L-shaped cutout, so that, for one wave, a top portion of the wave has a width l that is narrower than the rest of the wave, which has a width L and, for the other wave, a bottom portion has the width l and is narrower than the rest of the wave, which has a width L, where the total of l and L is equal to the total width of the passageways or b) the cutout in each wave has a zigzag shape;

at least two waves, preferably at least three waves, are superposed, each wave having a width greater than half of the total width of the passageways and less than the total width of the passageways, so that the waves overlap;

the waves are attached together by clips, locking keys and/or springs;

the waves are fitted together and/or fitted into each other.

Optionally waves with vertical generatrices placed beneath the packing element.

According to another subject of the invention, an installation for separating air by distillation is provided, of the type comprising a first distillation column operating at a relatively high pressure, a second distillation column operating at a relatively low pressure, and a heat exchanger making it possible to place the vessel liquid of the second column in a heat-exchange relationship with the head gas of the first column, characterized in that the heat exchanger is as defined above and in that the installation comprises supplying means for feeding the vessel liquid to the exchanger and means for supplying the passageways of the exchanger with gas.

DETAILED DESCRIPTION OF THE INVENTION

For a further understanding of the nature and objects for the present invention, reference should be made to the detailed description, taken in conjunction with the accompanying drawing, in which like elements are given the same or analogous reference numbers and wherein:

Installation of this kind for separating air correspond, for the known part, to a separation apparatus called a double-column apparatus, well known from conventional works.

Figure 1A:
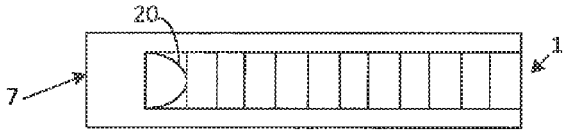
FIG. 1*a* illustrates an exchanger according to the prior art.
Figure 1B:
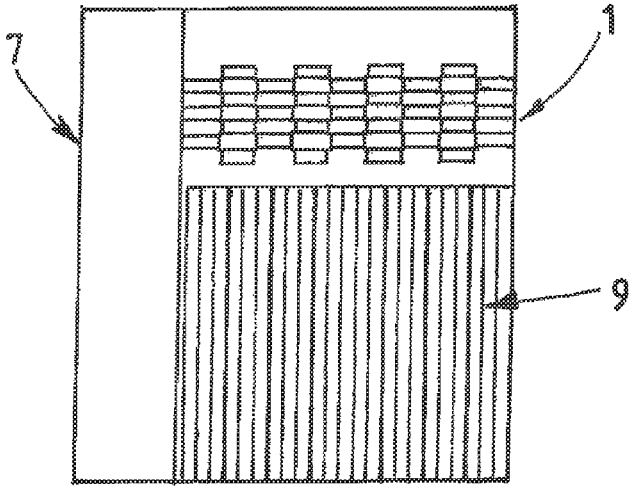
FIG. 1*b* illustrates an exchanger according to the prior art.
Figure 2:
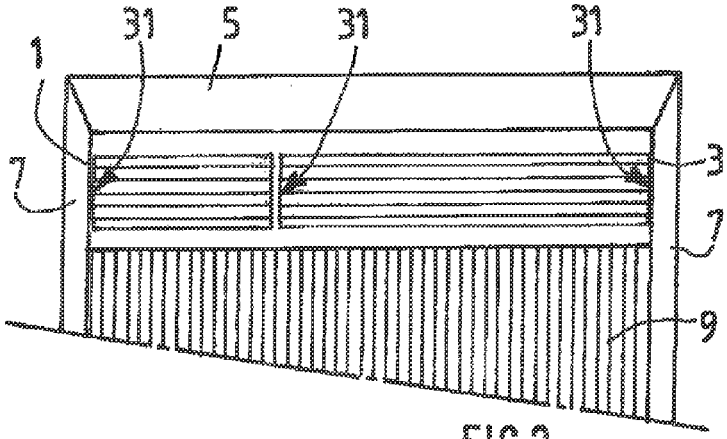
FIG. 2 illustrates an exchanger according to the prior art.
Figure 3A:
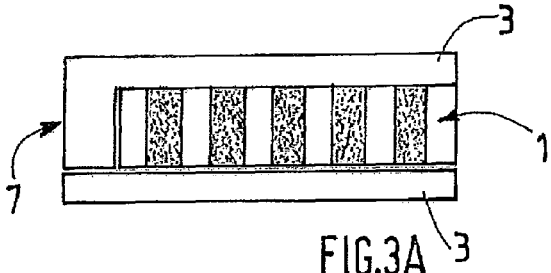
FIG. 3*a* illustrates one embodiment of the present invention.
Figure 3B:
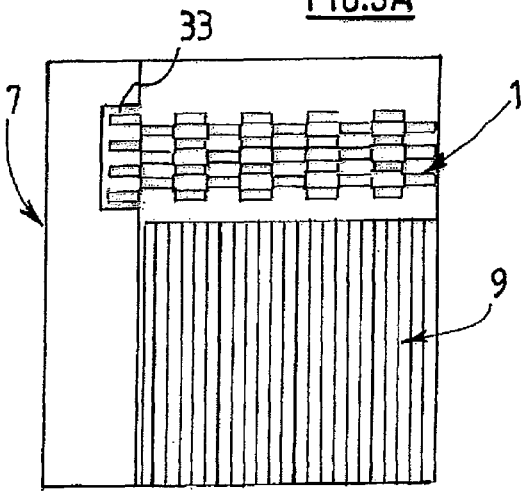
FIG. 3*b* illustrates one embodiment of the present invention.

This makes it possible for the edge of the wave 1, which is itself flat, to contact, over the whole of its surface, the surface of the bar, as can be seen in FIGS. 3A and 3B.

The proposed solution aims to remove or greatly reduce the free spaces that exist in the zone of the partially offset ("serrated") wave with a horizontal generatrix ("hardway") that is currently used. For this, it is proposed to remove the profile of the lateral bar over the height of the partially offset ("serrated") wave with horizontal generatrix ("hardway") (see FIG. 7). Moreover, care must be taken that the junctions between the partially offset ("serrated") wave mat with horizontal generatrix ("hardway") are placed end to end unless a single waveband is used over the whole width of the passageway.

Tests with liquid nitrogen on two small liquid-distribution models have made it possible to differentiate visually the distribution of the liquid leaving the partially offset ("serrated") wave with horizontal generatrix ("hardway"). The first model is fitted with two conventional lateral bars (with rounded profile) and the second is fitted with two lateral bars of which the empty spaces have been filled with aluminum in order to obtain a flat profile. The liquid nitrogen flow rate is approximately 0.7 l/h/channel, which is slightly less than the conventional flow rates used.

Figure 4A:
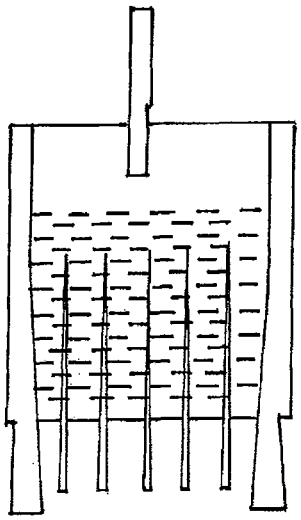
FIG. 4*a* illustrates one embodiment of the present invention.

The observations are as follows:

Model, bars with rounded profile according to the prior art: most of the flow rate runs through the free orifices of the lateral bars (FIG. 4A).

Figure 4B:
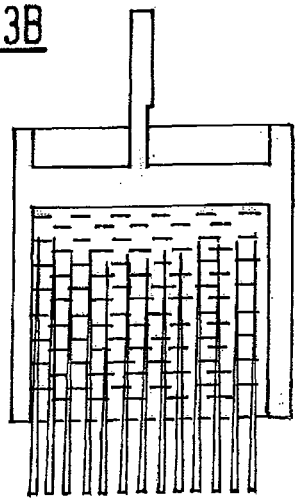
FIG. 4*b* illustrates one embodiment of the present invention.

Model, bars obstructed with flat profile according to the invention: the flow rate seems to be uniform and a level of liquid (illustrated in black) is observed above the partially offset ("serrated") wave with horizontal generatrix ("hardway") (FIG. 4B).

Assuming that the holes due to the profiled lateral bars cause a liquid undersupply over a space 20 mm wide, this corresponds to 2*20 or 40 mm for a 1 meter passageway, or 4% of channels are undersupplied. To this must be added other channels if there is a clearance between the partially offset ("serrated") wave mat with horizontal generatrix ("hardway").

Figure 12A:
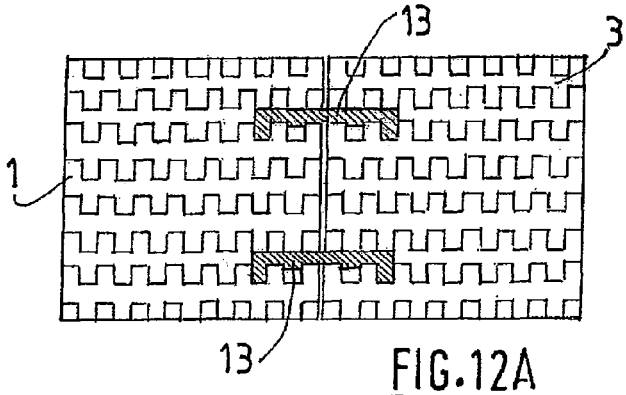
FIG. 12*a* illustrates one embodiment of the present invention.
Figure 12B:
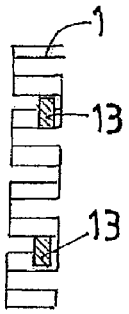
FIG. 12*b* illustrates one embodiment of the present invention.

The invention will be described in greater detail with reference to the figures where FIG. 3A represents a portion of the exchanger according to the invention seen from above; all the figures from FIG. 3B, except FIG. 12B, represent a cutaway of an exchanger according to the invention seen from the front and FIG. 12B represents a packing element of the exchanger according to the invention seen from the side.

Figure 5:
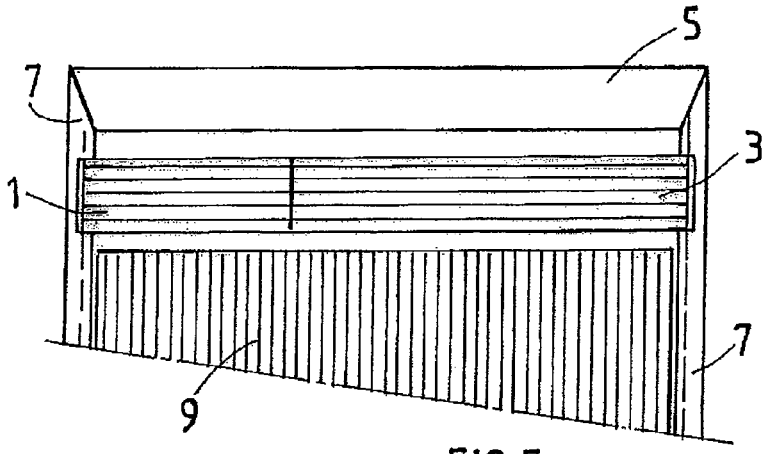
FIG. 5 illustrates one embodiment of the present invention.

In FIG. 5, an exchanger consists of an assembly of parallel vertical plates separated by bars 5,7 which block the passageways. The plates define between them a multitude of flat passageways. In order to distribute liquid oxygen in an air-separation apparatus, a packing element is placed at the top of the passageways, consisting of a first and a second wave 1,3, each wave being an unperforated aluminum sheet with horizontal generatrices (arrangement called "hardway" relative to the flow of liquid oxygen). At regular intervals, each horizontal or pseudo-horizontal facet 25 of the waves 1,3 is provided with a cleft (not illustrated) offset upward by a quarter of a wave pitch. The width of the clefts, measured along a generatrix of the wave, is of the same order as the distance that separates each of them from the two adjacent clefts situated on the same facet.

The liquid oxygen passes through holes placed above the packing element at a flow rate defined by the cross section of flow through said holes and by the height of liquid on top of said packing element. The holes therefore ensure a rough redistribution of the liquid oxygen all along the passageways, and the liquid oxygen thus predistributed sets off over the waves 1,3 which ensure a fine distribution for it over the whole length of each passageway. The liquid oxygen therefore approaches lower waves with vertical generatrix 9 by running down in a perfectly uniform manner over all the walls of the passageways that are assigned to it, that is to say by forming on these walls a continuous descending film.

At the same time, the gaseous nitrogen reaches the exchanger through distribution waves and then flows downward along other passageways. In so doing, it progressively transfers heat to the liquid oxygen that is in the adjacent passageways (not illustrated), so that the oxygen vaporizes and that, simultaneously, the nitrogen condenses.

The two waves 1,3 should have the same configuration in terms of shapes and dimensions and be placed so that their edges contact one another perfectly in order to prevent leaks of liquid.

It is not possible currently to manufacture waves that are long enough to cover the whole width of the exchanger. Therefore it is necessary to use two waves 1,3.

The bars 7 are formed with cutouts so that the wave 1 enters an opening in the bar on the left and the wave 3 enters an opening in the bar on the right. For this, the total length of the packing element formed by the waves must be greater than the distance between the two inner edges of the bars.

The waves with horizontal generatrix ("hardway") 1,3 are in abutment against one another, but since a clearance is required at each side bar 7 in order to allow an adjustment between tolerances of the waves and tolerances of the bars, there is a risk that the waves move during brazing.

Figure 6:
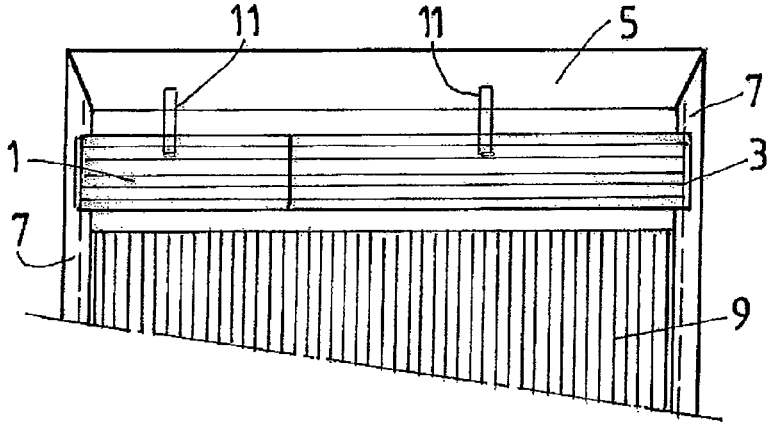
FIG. 6 illustrates one embodiment of the present invention.

As can be seen in FIG. 6, the waves can be attached to one another by lock keys of the parts 11 attached to the upper bar 5.

Figure 7:
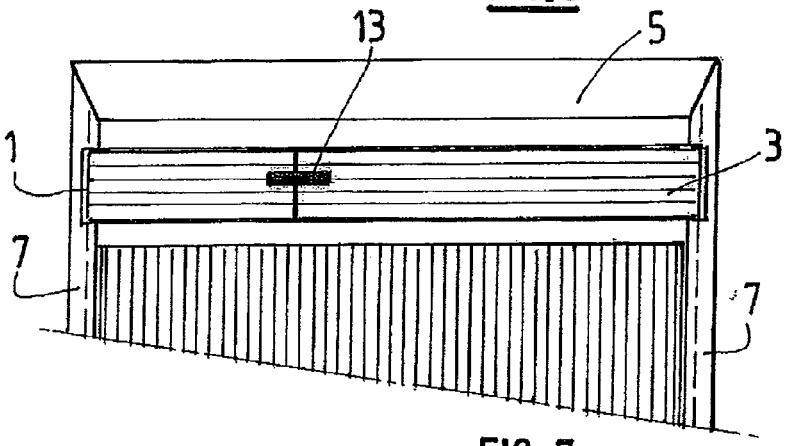
FIG. 7 illustrates one embodiment of the present invention.

FIG. 7 shows the waves being clipped together by a clip 13.

Figure 8:
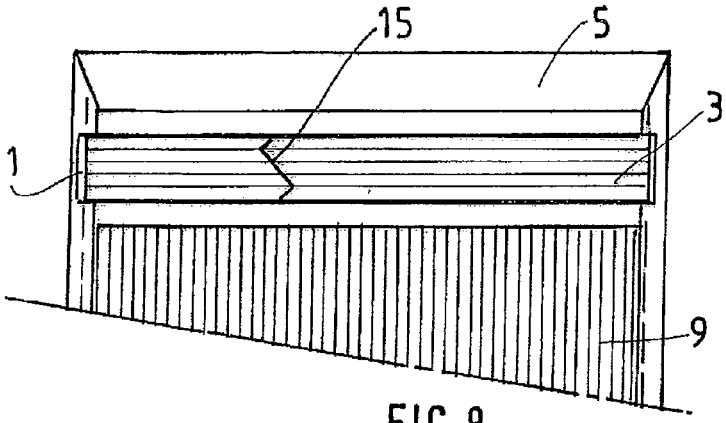
FIG. 8 illustrates one embodiment of the present invention.
Figure 9:
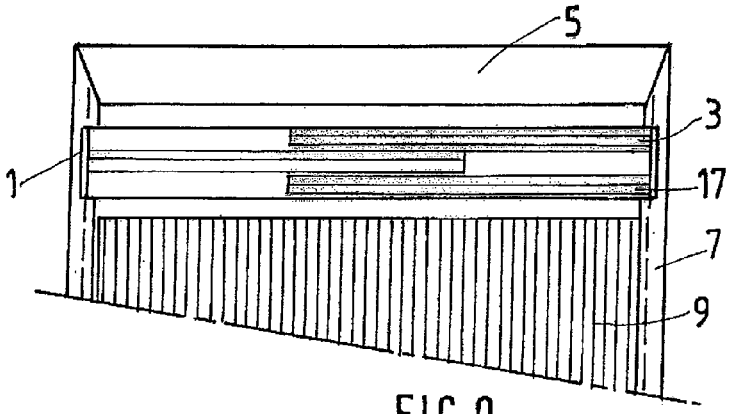
FIG. 9 illustrates one embodiment of the present invention.
Figure 10:
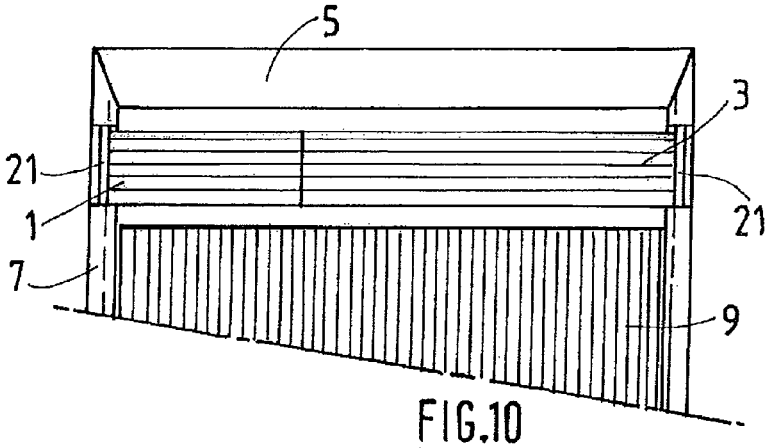
FIG. 10 illustrates one embodiment of the present invention.

In FIG. 8, the two waves are cut in the thickness in a zigzag so that the two cutouts match perfectly and there is no clearance between the waves.

In order to allow a better seal, it is possible to use wide waves and to overlap them. In figure there are three superposed waves 1,3 and 17, of which the waves 3 and 17 contact one edge of the exchanger and the wave l contacts the other. Each wave consists of two undulations and has the same width, equal to a value between half and all of the total width of the passageways. In this manner, the waves overlap forming a central portion having a thickness of six undulations.

The waves 1,3 can be locked together by wedges 21 placed between the bars 5 and each wave, as can be seen in FIG. 6.

Figure 11:
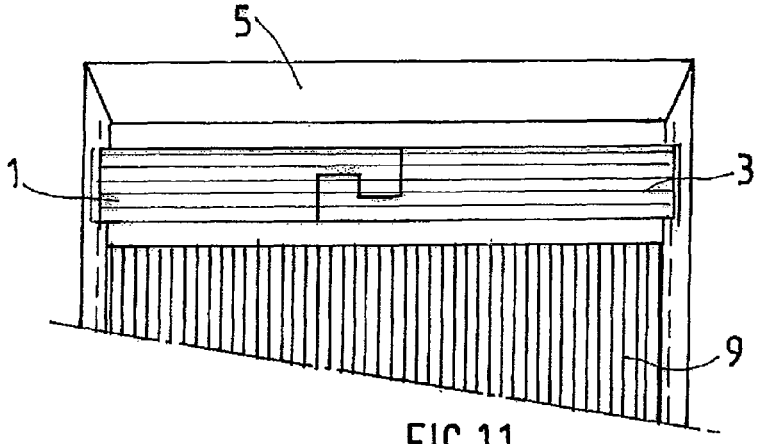
FIG. 11 illustrates one embodiment of the present invention.

In FIG. 11, it can be seen that the two waves 1,3 fit together and into each other.

FIGS. 12A and 12B show details of FIG. 7 where it can be seen that the clips 13 fit into the cutouts of the partially offset waves.

Figure 13:
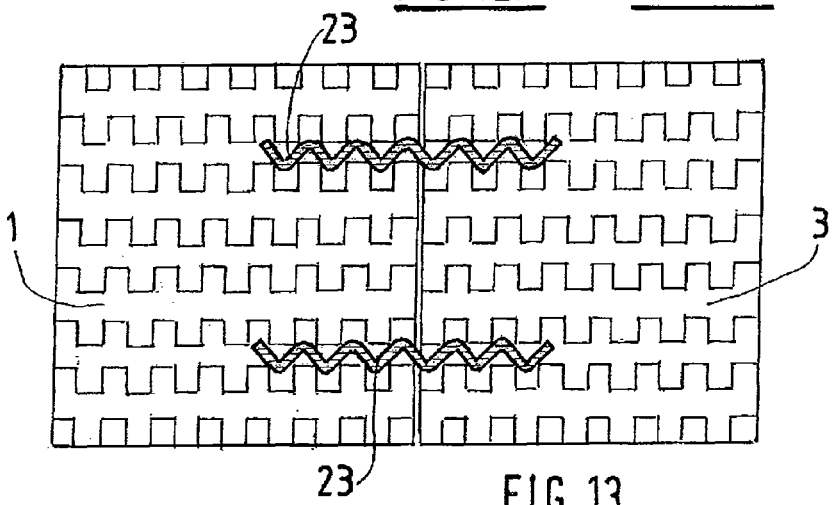
FIG. 13 illustrates one embodiment of the present invention.

FIG. 13 shows waves 1,3 attached by springs 23 which fit into several cutouts of each partially offset wave.

Figure 14:
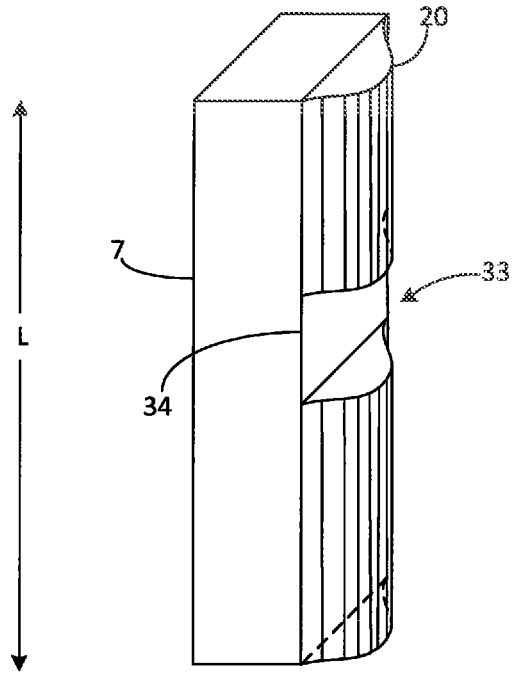
FIG. 14 provides a perspective view of one embodiment of the present invention.

FIG. 14 provides perspective view of one of the lateral bars 7, complete with a sinusoidal edge 20 (e.g., rounded profile) along a portion of its length (L), and a flat edge 34, which forms cutout 33.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A heat exchanger for vaporizing a liquid by exchanging heat with a second fluid, the heat exchanger comprising:

a parallelepipedal body formed of an assembly of parallel vertical plates and lateral bars defining between the parallel vertical plates a multitude of flat passageways and the lateral bars closing off the passageways to the outside, wherein the lateral bars extend vertically with the parallel vertical plates and are perpendicular to the parallel vertical plates;

means for sending the liquid into a first set of passageways and the second fluid into the remaining passageways; and a packing element configured to distribute the liquid at the top end of the passageways of said first set, over the whole horizontal length of said passageways, by a fine distribution over the whole length of these passageways;

wherein at least one of the lateral bars has, toward the inside of the exchanger, a rounded profile over most of its length and a flat profile over a portion of its length, wherein the flat profile is disposed on the lateral bars away from the inside of the exchanger as compared to the rounded profile thereby creating a cutout, and in that one edge of the packing element extends past the rounded profile and into the cutout.

2. The heat exchanger of claim 1, wherein the packing element is fitted into at least one of the lateral bars.

3. The heat exchanger of claim 1, wherein the packing element consists of at least two waves having a shape and a dimension of undulation that are substantially identical and with horizontal generatrices, the at least two waves contacting one another without leaving clearance between the waves.

4. The heat exchanger of claim 3, wherein the at least two waves have a partial vertical offset.

5. The heat exchanger of claim 3, wherein the at least two waves contact each other so that the edges of the undulations join perfectly.

6. The heat exchanger of claim 3, wherein the two waves mutually interpenetrate.

7. The heat exchanger of claim 2, wherein the two waves have at least one cutout and in that the cutouts of the two waves have matching shapes.

8. The heat exchanger of claim 7, wherein a) each wave has an L-shaped cutout, so that, for one wave, a top portion of the wave has a width l that is narrower than the rest of the wave, which has a width L and, for the other wave, a bottom portion has the width l and is narrower than the rest of the wave, which has a width L, where the total of l and L is equal to the total width of the passageways; or b) the cutout in each wave has a zigzag shape.

9. The heat exchanger of claim 1, wherein at least two waves, are superposed, each wave having a width greater than half of the total width of the passageways and less than the total width of the passageways, so that the waves overlap.

10. The heat exchanger of claim 9, comprising at least three waves.

11. The heat exchanger of claim 1, wherein the waves are attached together by clips, locking keys and/or springs.

12. The heat exchanger of claim 1, wherein the waves are fitted together and/or fitted into each other.

13. The heat exchanger of claim 1, comprising waves with vertical generatrices placed beneath the packing element.

14. An installation for separating air by distillation, of the type comprising a first distillation column operating at a relatively high pressure, a second distillation column operating at a relatively low pressure, and a heat exchanger making it possible to place the vessel liquid of the second column in a heat-exchange relationship with the head gas of the first column, Wherein the heat exchanger is as defined in claim 1 and in that the installation comprises supplying means for feeding the vessel liquid to the exchanger and means for supplying the passageways of the exchanger with gas.

* * * * *